US006457300B1

(12) United States Patent
Yang

(10) Patent No.: US 6,457,300 B1
(45) Date of Patent: Oct. 1, 2002

(54) PLASTIC FILM GUIDING DEVICE OF PACKAGING MACHINE

(76) Inventor: Chang Min Yang, P.O. Box 26-757, Taipei (TW)

( * ) Notice: Subject to any disclaimer, the term of this patent is extended or adjusted under 35 U.S.C. 154(b) by 78 days.

(21) Appl. No.: 09/755,803

(22) Filed: Jan. 4, 2001

(51) Int. Cl.[7] ..... B65B 9/06

(52) U.S. Cl. ..... 53/550; 53/568; 53/578; 493/475; 493/476; 493/478; 493/479

(58) Field of Search ..... 53/550, 560; 493/475, 493/476, 478, 479

(56) References Cited

U.S. PATENT DOCUMENTS 4,519,185 A * 5/1985 Horn et al. ..... 53/550
4,671,047 A * 6/1987 Mugnai ..... 53/550
5,799,467 A * 9/1998 Nankervis et al. ..... 53/550
5,987,860 A * 11/1999 Yang ..... 53/550

* cited by examiner

*Primary Examiner*—Rinaldi I. Rada
*Assistant Examiner*—Thanh Truong
(74) *Attorney, Agent, or Firm*—Rosenberg, Klein & Lee

(57) ABSTRACT

The present invention proposes a plastic film guiding device of a packaging machine, which comprises a frame, a screw rod, a walking block, a positioning rod, a pair of slanting rods, and a pair of slide bodies. The plastic film guiding device of the present invention is arranged in suspended way to reduce its contact with the surface of a machine table so that the present invention suffers less heat to facilitate the adjustment. Most importantly, the present invention has instant width-adjusting function, and can simultaneously perform identical adjustments to the widths of both sides. The adjustment is fast, and the positions of movement are exact. Moreover, fine adjustment of width can be performed at any time during the operation of the machine.

10 Claims, 7 Drawing Sheets

PLASTIC FILM GUIDING DEVICE OF PACKAGING MACHINE

FIELD OF THE INVENTION

The present invention relates to a plastic film guiding device of a packaging machine and, more particularly, to a moving structure of a guiding device, which is capable of simultaneously controlling the widths of both sides.

BACKGROUND OF THE INVENTION

FIG. 1 shows a prior art guiding device of packaging plastic film, wherein a pair of dissymmetrical bottom plates 11 are locked on a machine table, and a width-adjusting rod 12 is locked slantingly on the surface of each of the bottom plates 11. The width-adjusting rod 12 has a T-shaped cross section. A width-adjusting seat 13 is telescoped on the width-adjusting rod 12. A corresponding T-shaped groove is formed in the width-adjusting seat 13. A screw hole 14 penetrating to the T-shaped groove is formed on the side plane of the width-adjusting seat 13. The width-adjusting seat 13 is locked on the width-adjusting rod 11 through a turn button 15. Inclined planes are formed at the facing ends of the two width-adjusting seats 13. An article guiding rod 16 is joined at each of the two inclined planes so that the two article guiding rods 16 are parallel. The outer side of each of the article guiding rods 16 slantingly joins the lower end of a height-adjusting rod 17 with the vertical plane thereof. The height-adjusting rod 17 also has a T-shaped cross section. A height-adjusting seat 18 is telescoped on the height-adjusting rod 17. The height-adjusting seat 18 is C-shaped. The top plane of each of the height-adjusting seats 18 has a through screw hole 19. The height-adjusting seat 18 is locked on the height-adjusting rod 17 through a turn button 191. The inner side plane of each of the height-adjusting seats 18 joins a hooked plastic film guiding plate 192.

This prior art structure has been used for many years. Although its function is very good, its adjustment is not convenient. This prior art structure is joined against the surface of a machine table. The bottom plane of the machine table has a heating device. Guided-in plastic film is sleeved on an article and the both sides thereof are heated for packaging. For controlling the guiding-in of plastic film, the plastic film guiding device is provided to control the width and height of package. The length of package is also controlled using a cutting device at the rear end.

Because the mechanisms of the prior art are individually fixed, the assembly is not easy after disassembled for maintenance or cleaning so that professional technicians are required. Therefore, the adjustment of the prior art structure is not convenient. All turn buttons must be loosened beforehand when setting each specification to perform the adjustment. Especially, because the installed position thereof is very near the heating device, the machine must be halt when the adjustment is performed. That is, heating must be stopped to facilitate manual adjustment. Moreover, the adjustment is separately performed at both sides, and the control is carried out through the help of scale rules at both sides. However, slight error still exists. Therefore, the run-in time and process are relatively lengthened. The present invention aims to resolve the above problems in the prior art.

SUMMARY OF THE INVENTION

One object of the present invention is to provide a plastic film guiding device of a packaging machine. The guiding device is arranged in suspended way to reduce its contact with the surface of a machine table so that the present invention suffers less heat to facilitate the adjustment. Most importantly, the present invention has instant width-adjusting function, and can simultaneously perform identical adjustments to the widths of both sides. The adjustment is fast, and the positions of movement are exact. Moreover, fine adjustment of width can be performed at any time during the operation of the machine.

The present invention comprises a frame, a screw rod, a walking block, a positioning rod, a pair of slanting rods, and a pair of slide bodies. The frame comprises two bottom plates, two side plates, a top plate, a front axle sheet, and a rear axle sheet. The front and rear axle sheets are installed at the centerline of the frame. The front axle sheet has a pivotally-joining hole, and the rear axle sheet has a screw hole. The screw rod penetrates the screw hole with the front end thereof joined in the pivotally-joining hole and the rear end thereof joining an adjuster. A screw hole penetrating from front to rear is formed in the walking block to be passed through by the screw rod so that the walking block can be led to move forwards or backwards by the screw rod. A transverse hole is formed at the bottom of the walking block. The positioning rod is threaded in the transverse hole to be fixed perpendicular to the screw rod. The inner end of the slanting rod is joined at the top plate, and the outer end thereof protrudes out forwards. The positioning rods are symmetrically arranged. Each slide body has a slide block and a guide block. Each slide block is telescoped in the slanting rod via a slide groove. The inner end of the slide block joins downwards the guide block so that the two guide blocks are parallel arranged. The guide block joins one end of a height-adjusting rod. The pair of guide blocks are led to move by the adjuster for controlling the guided-in width of plastic film and for successfully guiding in articles. The height-adjusting rod is joined on the outer side plane of the guide block and is slantingly forward and upward. A fixing block is telescoped on the height-adjusting rod. The fixing block has a slide way therein to be passed through and has a control turn button for adjustment. The outer end of the height-adjusting rod joins a hooked plastic film guiding plate. An adjustable hanging device is provided above the top plate.

The various objects and advantages of the present invention will be more readily understood from the following detailed description when read in conjunction with the appended drawings, in which:

DETAILED DESCRIPTION OF THE PREFERRED EMBODIMENTS

Figure 1:
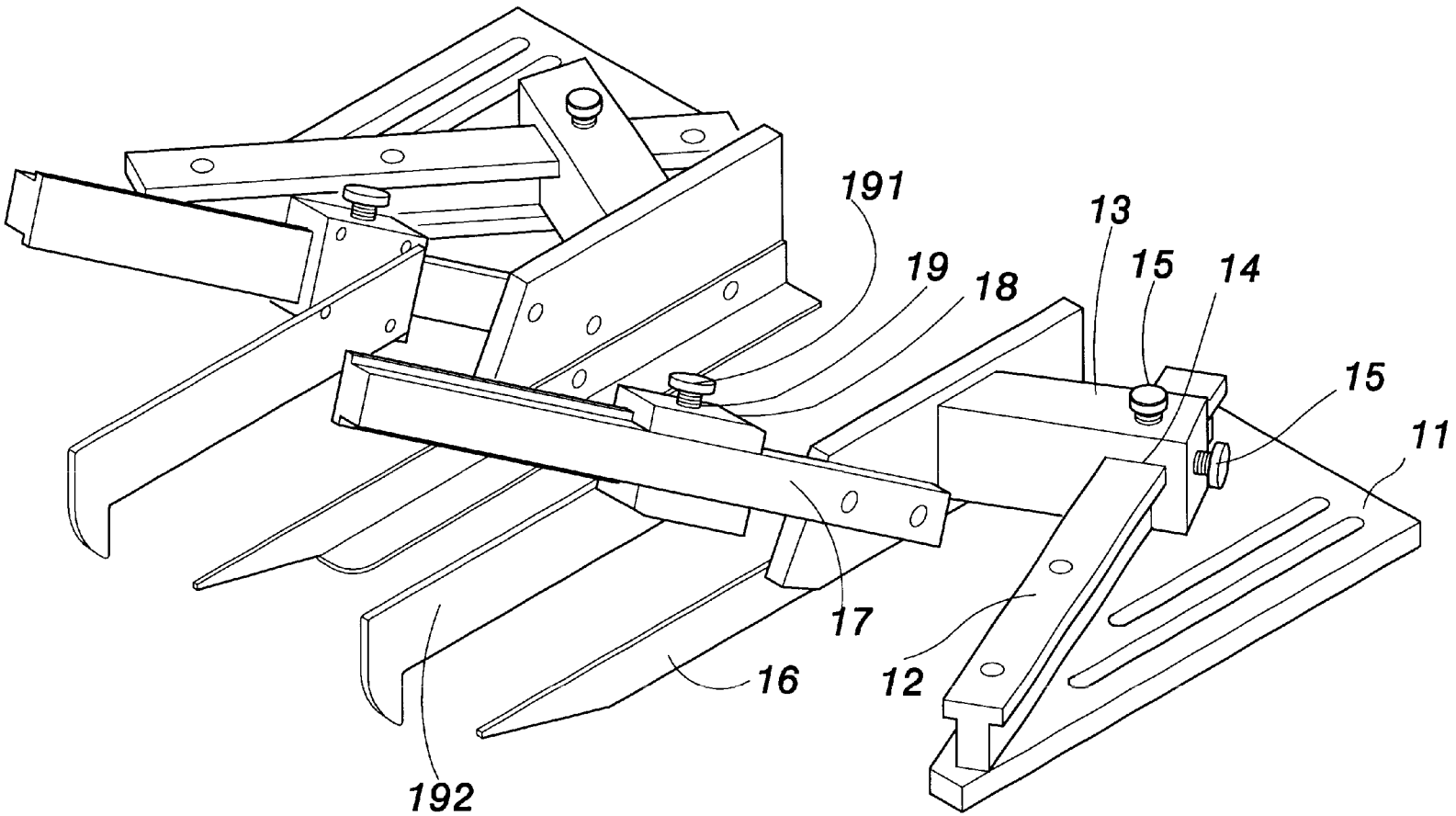
FIG. 1 PRIOR ART
FIG. 1 is a perspective view of the prior art.
Figure 2:
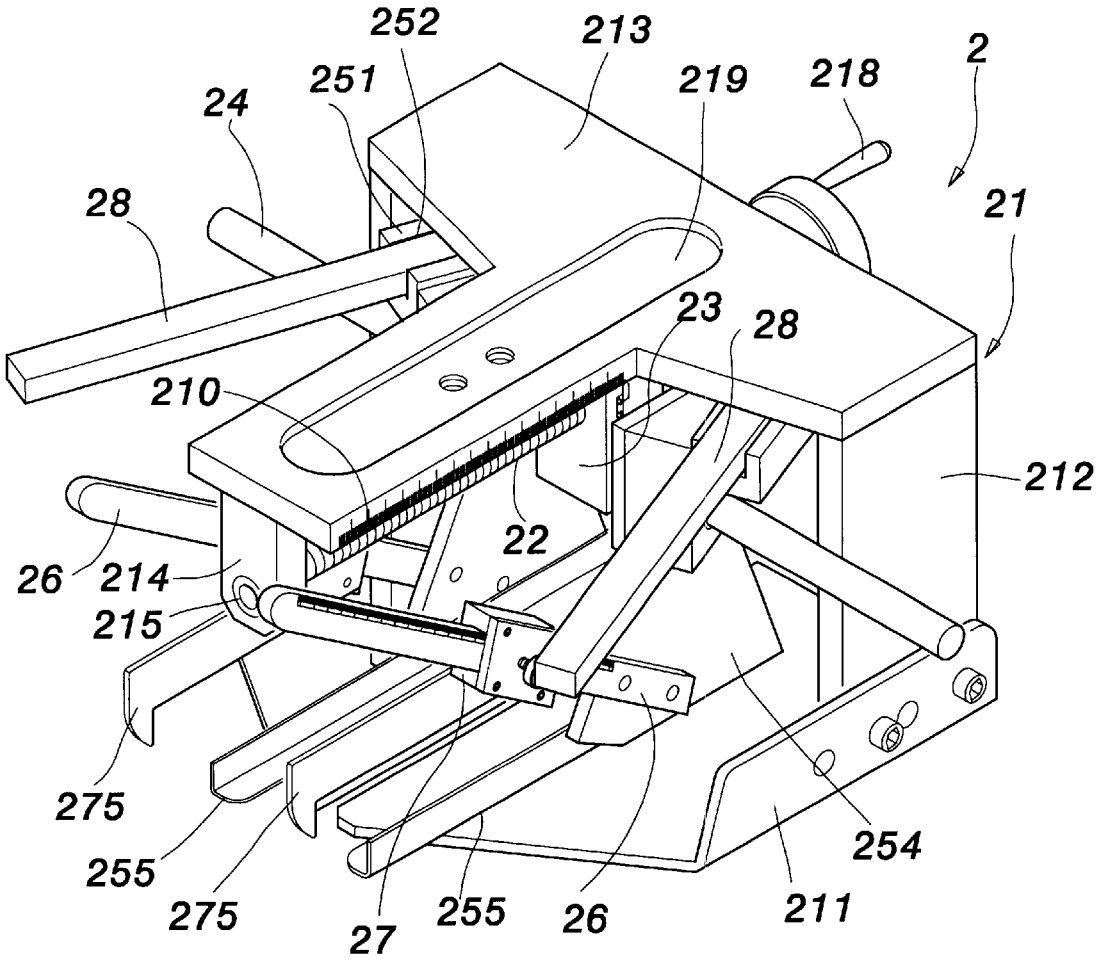
FIG. 2 is a perspective view of the present invention.
Figure 3:
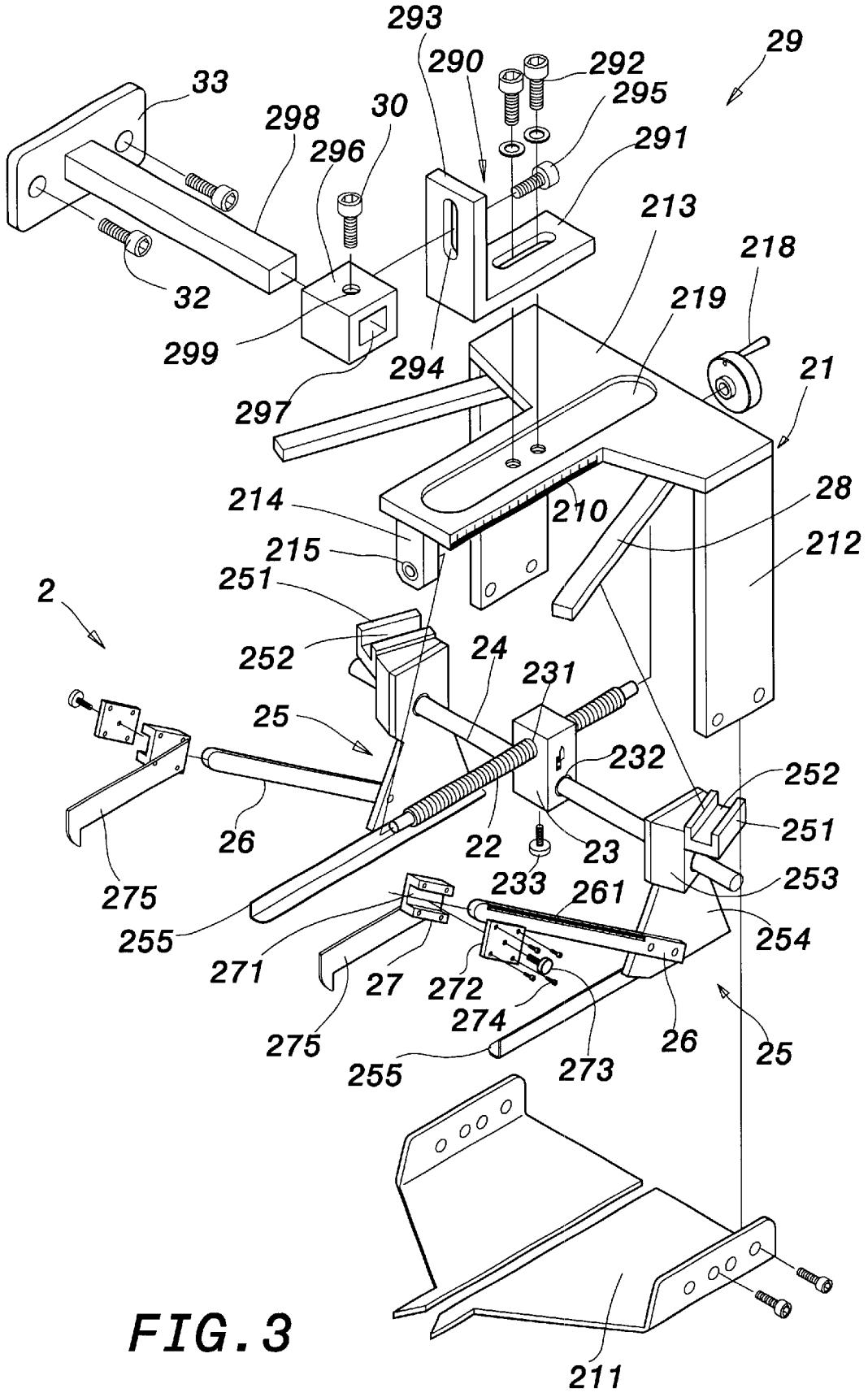
FIG. 3 is an exploded perspective view of the present invention.
Figure 4:
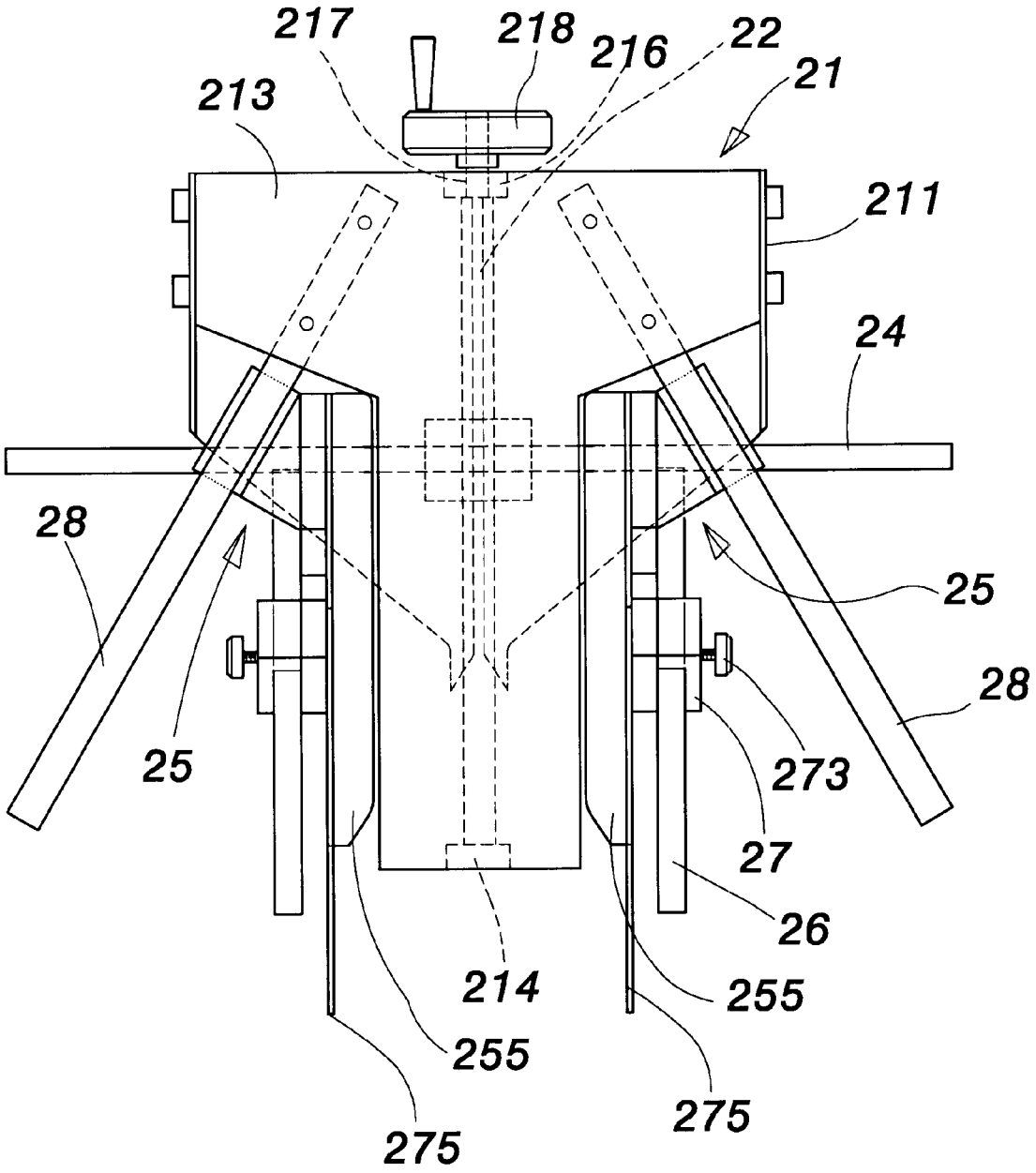
FIG. 4 is a top view of the present invention when not moved yet.

As shown in FIGS. 2 to 6, a plastic film guiding device 2 of a packaging machine of the present invention comprises a frame 21, a screw rod 22, a walking block 23, a positioning rod 24, a pair of slanting rods 28, and a pair of slide bodies 25. The frame 21 comprises two bottom plates 211, two side plates 212, a top plate 213, a front axle sheet 214, and a rear axle sheet 216. The front axle sheet 214 and the rear axle sheet 216 are provided at the centerline of the frame 21. The front axle sheet 214 has a pivotally-joining hole 215, and the rear axle sheet 216 has a screw hole 217.

The screw rod 22 penetrates the screw hole 217 with the front end thereof joined in the pivotally-joining hole 215 and the rear end thereof joining an adjuster 218 (such as a manual wheel shown in the figure). The screw rod 22 is driven by the adjuster 218.

A screw hole 231 penetrating from front to rear is formed in the walking block 23 to be passed through by the screw rod 22 so that the walking block 23 can be led to move forwards or backwards by the screw rod 22. A transverse hole 232 and a bottom screw hole 234 are formed at lower part of the bottom of the walking block 23. The positioning rod 24 is threaded in the transverse hole 232 to be fixed perpendicular to the screw rod 22.

As shown in the FIGS. 2 to 6, the positioning rod 24 can be a circular transverse rod passing through the transverse hole 232, and is fixed in the walking block 23 by locking a stud 233 in the bottom screw hole 234 of the walking block 23. The inner end of the slanting rod 28 is joined on the top plate 213, and the outer end thereof protrudes out forwards. The positioning rods 28 are symmetrically arranged with respect to the centerline of the frame 21 to be approximately A-shaped.

Each of the slide bodies 25 has a slide block 251 and a guide block 254. Each slide block 251 is telescoped in the slanting rod 28 via a slide groove 252. As shown in the FIGS. 2 to 6, the slanting rods 28 seem to be not connected to the slide groove 252. There are two ways to resolve this problem. The first way: a slide block of a linear bearing is formed on the periphery of the slanting rod, and the slide track of the linear bearing is fixedly provided in the slide groove 252, thereby forming a linear slide structure. The second way: the slide groove 252 forms a mouth-shaped passage, and the slide bodies 25 are directly hanged on the slanting rods 28. The inner end of the slide block 251 joins downwards the guide block 254 so that the two guide blocks 254 of the two slide bodies 25 are parallel arranged. The guide block 254 joins one end of a height-adjusting rod 26.

As shown in the FIGS. 2 to 6, the slide block is slightly triangular. The top end of the guide block 254 is joined on the side plane of the slide block 251 by means of a triangular block 253. The inner side of the lower end of the guide block 254 joins an L-shaped guide plate 255. The outer end of the L-shaped guide plate 255 protrudes out forwards. The L-shaped guide plate 255 is used for controlling the guided-in width of the plastic film 4 and for successfully guiding in articles.

The height-adjusting rod 26 is joined on the outer side plane of the guide block 254 and is slantingly forward and upward. A fixing block 27 is telescoped on the height-adjusting rod 26. The fixing block 27 has a slide way 271 therein to be passed through and has a control turn button 273 for locking and adjusting. The fixing block 27 is covered by a cover plate 272, which is locked on the fixing block 27 with a plurality of small screws screwed in holes of the cover plate 272. The control turn button 273 also passes through a central hole of the cover plate 272 to be locked on the surface of the height-adjusting rod 26. The outer end of each height-adjusting rod 26 joins a hooked plastic film guiding plate 275. The plastic film guiding plate 275 is used for guiding in the plastic film 4.

Each height-adjusting rod 26 has scales 261 thereon. The fixing block 27 moves upwards and downwards on the height-adjusting rod 26 to set the guided-in height of the plastic film 4. A scale ruler 210 is provided on the side plane of the front section of the top plate 213 for controlling the to and fro motion and the expanded size of the slide bodies 25 so as to become the control scales for width adjustment.

Figure 6:
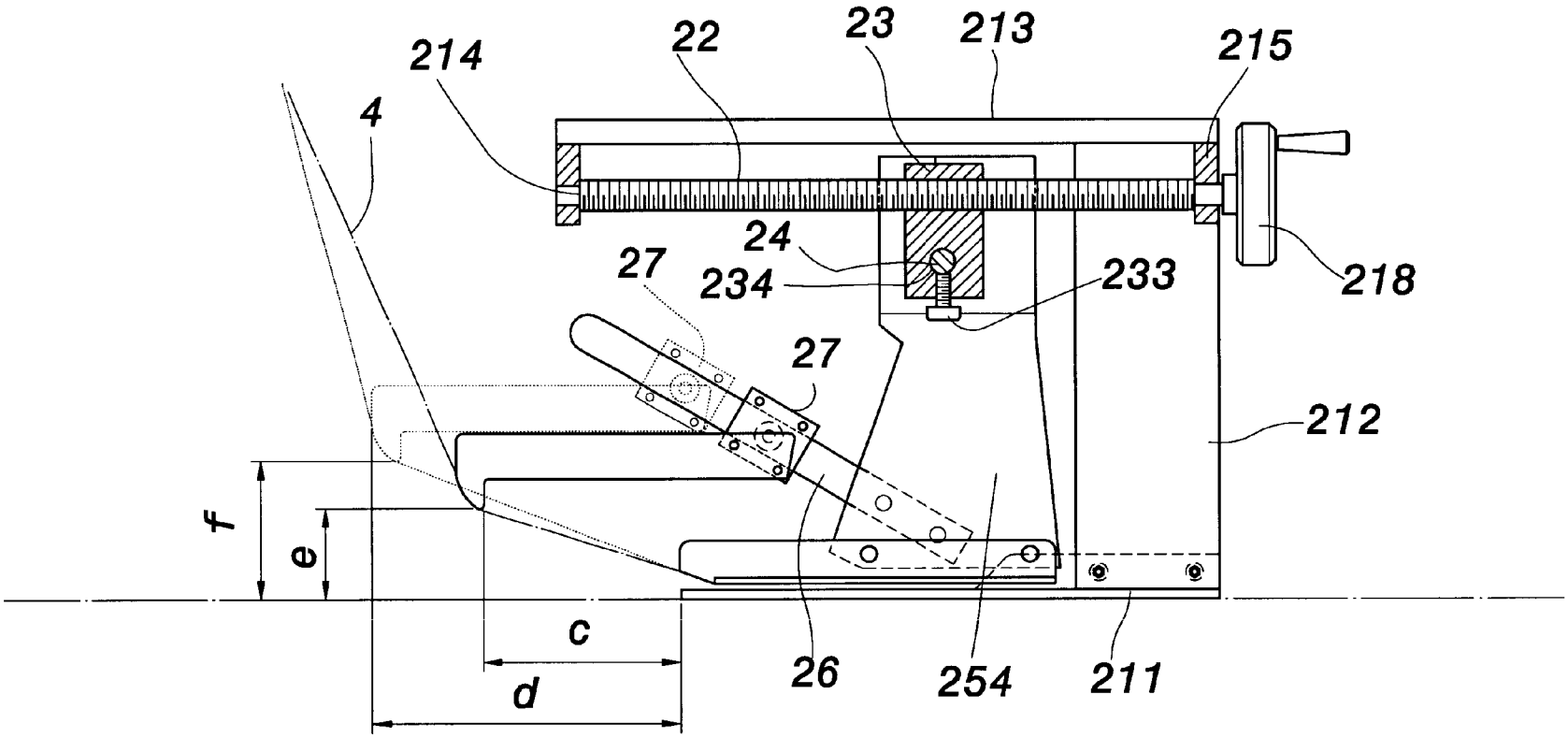
FIG. 6 is a side view of the present invention when performing height adjustment.

As shown in FIG. 6, when the fixing block 27 is moved upwards (outwards) from a distance of length e to a distance of length f away from the bottom of the bottom plate 211, and also from a distance of length c to a distance of length d away from the front end of the bottom plate 211, the height adjustment of the guided-in plastic film is completed.

Figure 7:
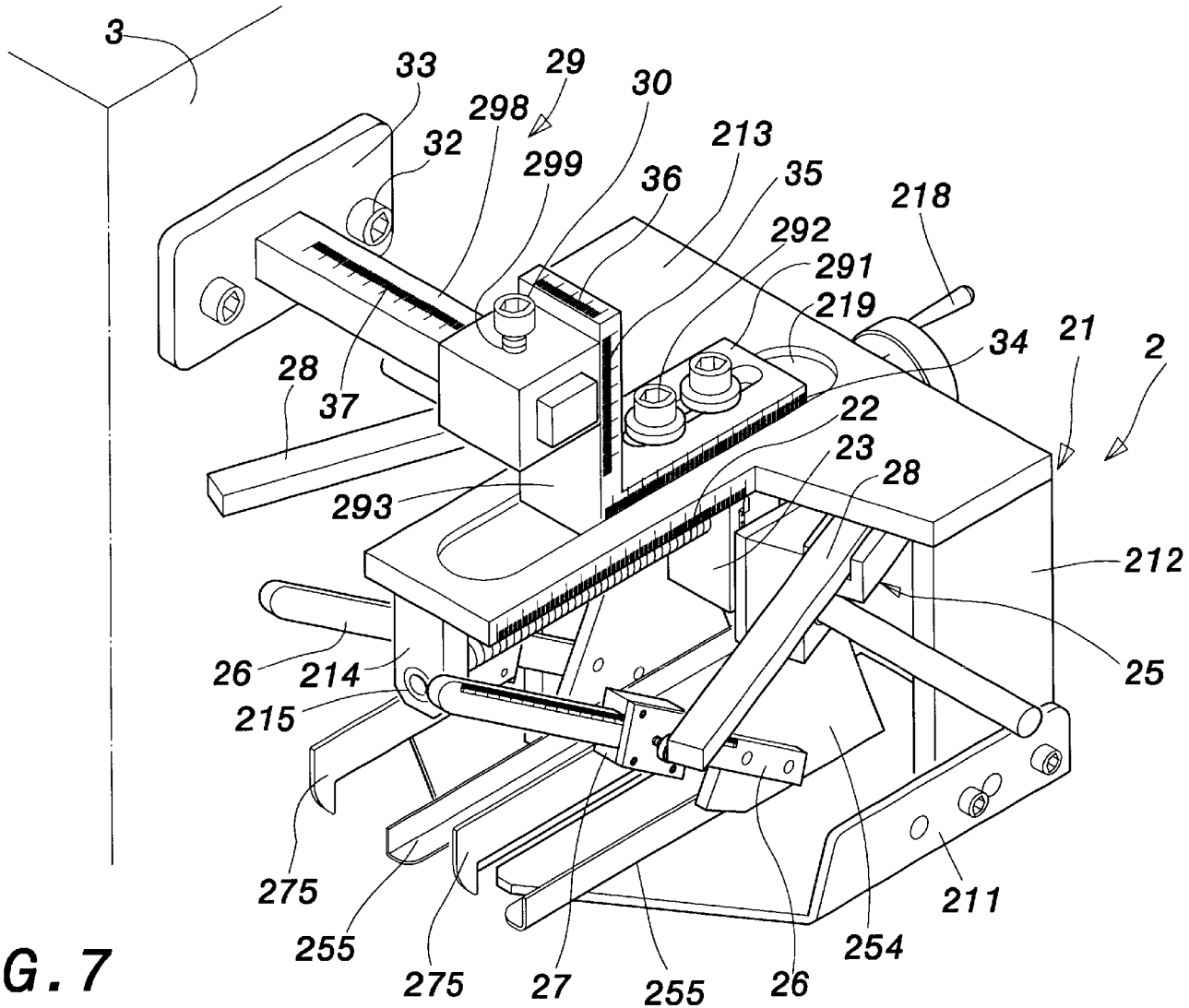
FIG. 7 is a perspective view of the present invention with a hanging device attached thereon.

The present invention can also be hanging type. As shown in FIG. 7, a hanging device 29 is provided above the top plate and is joined at the centerline of the frame. The top plate 213 has a slide groove 219. The two sides of a horizontal part 291 of an L-shaped plate 290 are joined in the slide groove 219. The relationship between the slide groove 219 and the L-shaped plate 290 can be the relationship between a T-shaped groove and a raised edge or the relationship between similar structures. At least a fixing screw 292 is provided above the L-shaped plate 290 to pass from a long hole of the horizontal part 291 to the screw hole of the top plate 213 so that not only the L-shaped plate 290 can join the guiding device 2, but also the for and aft position of the guiding device 2 can be adjusted.

The front end of a vertical part 293 of the L-shaped plate 290 joins an adjusting block 296. The vertical part 293 has a long hole 294. An adjusting screw 295 passes through the long hole 294 to lock the L-shaped plate 290 on the surface of the adjusting block 296. The adjusting screw 295 can be loosened for adjusting the height of the adjusting block 296 so that the up and down height of the guiding device 2 of the present invention can be adjusted. A scale ruler 35 can be provided on the side surface of the vertical part 293 of the L-shaped plate 290 for adjusting the height of the hanging device 29.

A through groove 297 is formed in the adjusting block 296 to be penetrated by a rod 298 (a circular rod or a square rod). A positioning screw 30 on the top plane of the adjusting block 296 is locked in the screw hole 299 of the adjusting block 296 for adjusting the left and right position of the guiding device 2 of the present invention. A scale ruler 37 can be provided on the rod 298, and a scale ruler 36 can be provided on the top side surface of the vertical part of the L-shaped plate 290 for adjusting the horizontal position of the hanging device 29.

The other end of the rod 298 is joined on a side plane 3 of a machine table through an eared fixing seat 33. The rod 298 is locked on the machine table with a pair of screws 32 passing through holes of the eared fixing seat 33. Thereby, the present invention can be hanged above the surface of the machine table, showing a structure different from the prior art.

Figure 5:
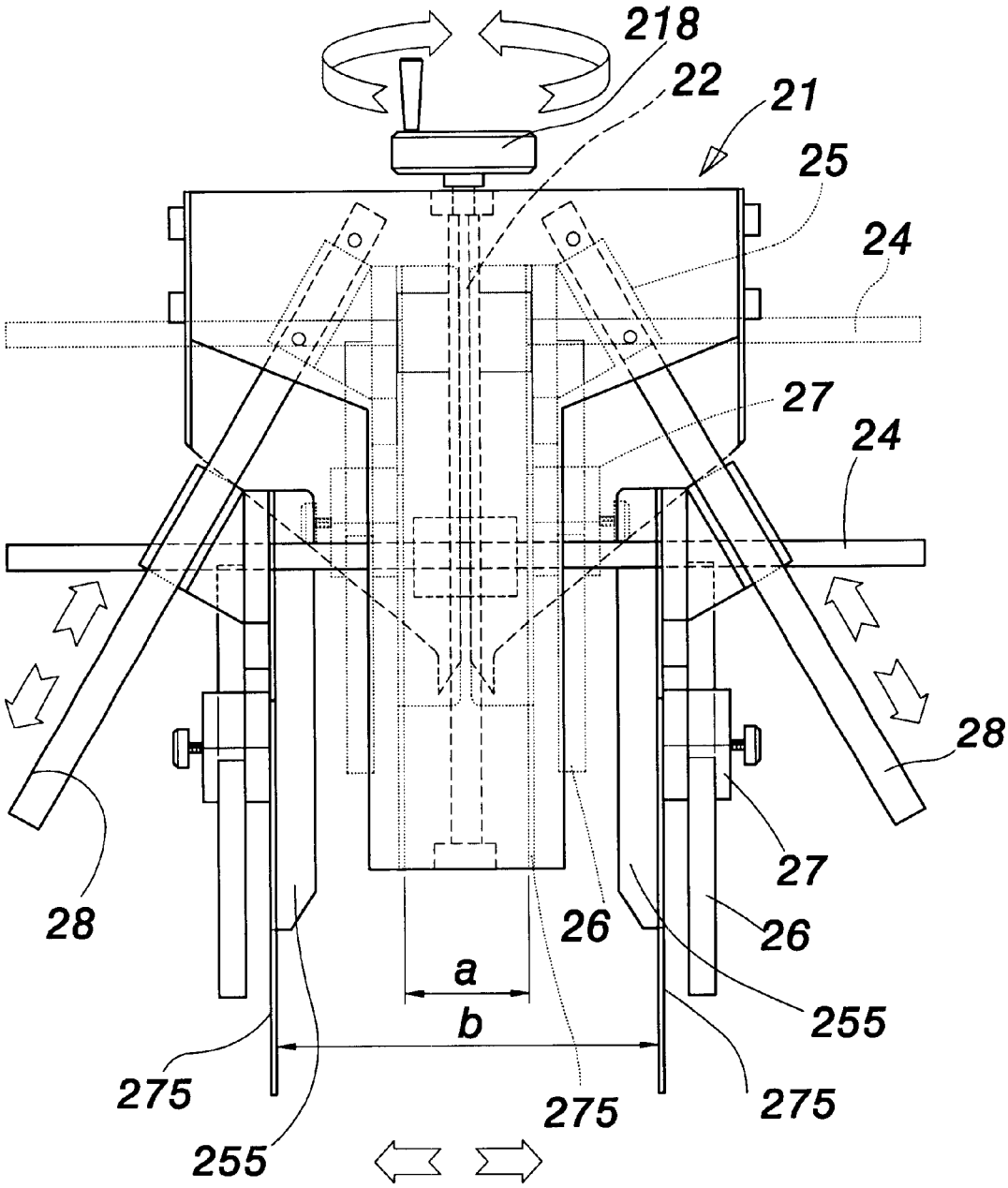
FIG. 5 is an action position diagram of the present invention when already moved.

The present invention utilizes the turn of an adjuster to lead a pair of slide bodies 25. Because a pair of slanting rods 28 is arranged as A-shape, the slide bodies will generate synchronous left and right motion, i.e., simultaneous motion toward or away from each other. As shown in FIG. 5, solid lines show the position before adjustment, while dashed lines show the position after adjustment. The distance between the two L-shaped guiding plates 255 is b before adjustment, and the distance between them becomes a after adjustment. As shown in FIG. 5, the outer ends of the L-shaped guide plates 255 shrink from outer site to inner site. Thereby, the width control of the guiding device 2 becomes synchronous shrinkage or enlargement, and the adjustment can be performed whenever and wherever. In other words, instant adjustment can also be performed during the process. This is totally different from the prior art. Moreover, it is not necessary to adjust a pair of turn buttons as the prior art, and it is not necessary to halt the machine for adjustment.

Furthermore, a hanging device is added in the present invention to hang the guiding device 2 high. This is totally different from the prior art, wherein the guiding device can only be installed on the surface of a machine table. Therefore, the heat suffered by the whole guiding device can be reduced so that width and height adjustment can be performed more conveniently. The present invention utilizes a pair of fixing blocks for height adjustment. Therefore, the present invention has better effects of guiding and adjustment for plastic film than the prior art.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

I claim:

1. A plastic film guiding device of a packaging machine, comprising:

a frame comprising two bottom plates, two side plates, a top plate, a front axle sheet, and a rear axle sheet, said front and rear sheets being respectively provided at the front and rear centerlines of said frame, said front axle sheet having a pivotally-joining hole, said rear axle having a screw hole;

a screw rod penetrating through said screw hole of said rear axle sheet with the front end thereof joined in said pivotally-joining hole and the rear end thereof joining an adjuster, said screw rod being driven by said adjuster;

a walking block having a screw hole penetrating from front to rear, said screw hole of said walking block being penetrated by said screw rod, said walking block being driven to move forwards and backwards by said screw rod, said walking block having a transverse hole below said screw hole of said walking block;

a positioning rod penetrating through said transverse hole of said walking block, said positioning rod being fixed perpendicular to said screw rod;

a pair of slanting rods with the inner end thereof joined on said top plate of said frame and the outer end thereof protruding out forwards; and a pair of slide bodies each having a slide block and a guide block, each said slide block being telescoped on said slanting rod via a slide groove, the inner end of each said slide block joining downwards said guide block so that said two guide blocks are parallel arranged, said slide bodies being driven by said adjuster to let said two guide blocks move toward or away from each other.

2. The plastic film guiding device of a packaging machine as claimed in claim 1, wherein the periphery of said slanting rod forms a linear bearing, and a slide track of said linear bearing is fixedly provided in said slide groove of said slide block of said slide body.

3. The plastic film guiding device of a packaging machine as claimed in claim 1, wherein the upper end of said guide block is joined on the side plane of said slide block by means of a triangular block, and the inner side of the lower end of said guide block joins an L-shaped guide plate, said L-shaped guide plate being used for controlling the guided-in width of plastic film and for successfully guiding in articles.

4. The plastic film guiding device of a packaging machine as claimed in claim 1, wherein said guide block joins one end of a height-adjusting rod.

5. The plastic film guiding device of a packaging machine as claimed in claim 4, wherein said height-adjusting rod is joined on the outer side plane of said guide block and is slantingly forward and upward, and a fixing block is telescoped on said adjusting rod, said fixing block having a slide way to be passed through and having a control turn button for adjustment, the outer end of said adjusting rod joining a hooked plastic film guiding plate used for guiding in plastic film.

6. The plastic film guiding device of a packaging machine as claimed in claim 1, wherein a hanging device is joined above said top plate.

7. The plastic film guiding device of a packaging machine as claimed in claim 6, wherein said hanging device is joined at the centerline of said guiding device, said top plate having a slide groove, the two sides of a horizontal part of an L-shaped plate being joined in said slide groove, a fixing screw being provided above said L-shaped plate for adjusting the fore and aft position of said guiding device.

8. The plastic film guiding device of a packaging machine as claimed in claim 7, wherein the front end of a vertical part of said L-shaped plate joins an adjusting block, said vertical part having a long hole, an adjusting screw passing through said long hole to be locked in said adjusting block for adjusting the height of said adjusting block so that the up and down position of said guiding device can be adjusted.

9. The plastic film guiding device of a packaging machine as claimed in claim 8, wherein a through groove is formed in said adjusting block to be penetrated by a rod, a positioning screw on the top plane of said adjusting block being joined on the surface of said rod for adjusting the left and right position of said guiding device.

10. The plastic film guiding device of a packaging machine as claimed in claim 9, wherein the other end of said rod is joined on the side plane of a machine table.

* * * * *